United States Patent [19]

Enami

[11] Patent Number: 5,031,440

[45] Date of Patent: Jul. 16, 1991

[54] APPARATUS FOR FORMING LONG PLATE MEMBER

[75] Inventor: Toshiaki Enami, Osaka, Japan

[73] Assignee: Enami Seiki Mfg., Co. Ltd., Yao, Japan

[21] Appl. No.: 479,405

[22] Filed: Feb. 13, 1990

[30] Foreign Application Priority Data

Feb. 15, 1989 [JP] Japan ..... 1-35673

[51] Int. Cl.[5] ..... B21D 5/06

[52] U.S. Cl. ..... 72/414; 72/421; 72/176

[58] Field of Search ..... 72/166, 383, 381, 414, 72/413, 307, 184, 190, 379.2, 420, 421, 176

[56] References Cited

U.S. PATENT DOCUMENTS 3,119,432 1/1964 Rogers ..... 72/176

3,485,080 12/1969 Lehmann ..... 72/421

*Primary Examiner*—Lowell A. Larson

*Assistant Examiner*—Michael McKeon

*Attorney, Agent, or Firm*—W. G. Fasse; D. H. Kane, Jr.

[57] ABSTRACT

A forming apparatus for shaping a long plate member (31), converts on initial cross-section into a final sectional configuration, e.g., into a U-shaped final sectional configuraiton. The forming apparatus has an upper die (32) and a lower die (33) defining a forming part with pressing surfaces which are movable toward each other for a pressing operation. The long plate member is appropriately fed into the forming part. A drive mechanism reciprocates the upper die (32). The forming part defined by the upper die (32) and by the lower die (33) includes an initial forming region which is located on an inlet for the long plate member. The initial forming region has a forming configuration corresponding to a flat sectional configuration. A final forming region located at an outlet for the long plate member has a forming configuration corresponding to a U-shaped sectional configuration. Intermediate forming regions located between the inlet and the outlet have regions, of sectional configurations that change continuously along a feed advance direction so that the forming configuration of the initial forming region approaches or merges into the forming configuration of the final forming region.

7 Claims, 10 Drawing Sheets

APPARATUS FOR FORMING LONG PLATE MEMBER

FIELD OF THE INVENTION

The present invention relates to an apparatus for forming a plate member, and more particularly, it relates to an apparatus for shaping a long plate member, which is fed as an initial sectional configuration, into a desired final sectional configuration.

BACKGROUND INFORMATION

A roll forming apparatus is known as an apparatus for manufacturing a sectionally L-shaped long plate member as shown in FIG. 8 or a sectionally U-shaped long plate member as shown in FIG. 9. FIGS. 13A to 13E schematically illustrate such a roll forming apparatus, which is adapted to form a sectionally U-shaped long plate member. FIG. 12 is a side elevational view showing this apparatus, and FIGS. 13A to 13E are illustrative front sectional views taken along the lines A—A, B—B, C—C, D—D and E—E in FIG. 12 respectively.

The roll forming apparatus comprises a first forming part 4, a second forming part 5, a third forming part 6, a fourth forming part 7, and a fifth forming part 8. A flat plate member 3 is continuously fed into the apparatus along an arrow X shown in FIG. 12.

Referring to FIG. 13A, the first forming part 4 has a support roller 9 for supporting the lower portion of the plate member 3, and a presser roller 10 for pressing the plate member 3 from above. The plate member 3 passes through the first forming part 4 while maintaining a flat configuration.

Referring to FIG. 13B, the second forming part 5 has a support roller 11 for supporting the lower central portion of the plate member 3, a presser roll 12 for pressing the plate member 3 from above, and inclined rollers 13*a* and 13*b* for supporting lower side portions of the plate member 3. As shown in FIG. 13B, the inclined rollers 13*a* and 13*b* are located at angles slightly inclined with respect to the support roll 11. When the plate member 3 passes through the second forming part 5, both side portions of the plate member are slightly bent upwardly by the inclined rolls 13*a* and 13*b*.

Referring to FIG. 13C, the third forming part 6 comprises a support roller 14, a presser roller 15 and inclined rollers 16*a* and 16*b*. The inclined rollers 16*a* and 16*b* are larger in inclination than the inclined rollers 13*a* and 13*b* shown in FIG. 13B. Therefore, the side portions of the plate member 3 are further bent at larger angles when the same passes through the third forming part 6.

Referring to FIG. 13D, the fourth forming part 7 comprises a support roller 17, a presser roller 18 and inclined rollers 19*a* and 19*b*. The inclined rollers 19*a* and 19*b* have a larger inclination than the inclined rollers 16*a* and 16*b* shown in FIG. 13C. Therefore, the side portions of the plate 3 are further bent at larger angles when the same passes through the fourth forming part 7.

Referring to FIG. 13E, the fifth forming part 8 comprises a support roller 20, a presser roller 21, and inclined rollers 22*a* and 22*b*. The inclined rollers 22*a* and 22*b* are positioned substantially orthogonally to the support roller 20. When the plate member 3 passes through the fifth forming part 8, therefore, the side portions thereof are bent substantially at right angles to the central portion. Thus, the plate member 3 is shaped into a sectionally U-shaped long plate member along a desired configuration.

In the aforementioned forming roller apparatus, the forming parts must be spaced apart with at least constant distances, due to a restriction imposed by mechanical characteristics of the apparatus itself and due to a limitation in the strength of the object to be formed. Thus, the overall length of the apparatus is considerably increased.

Further, when the forming roller apparatus is applied to forming a sectionally U-shaped long plate member 23*b* shown in FIG. 11 from a flat plate member 23*a*, which is provided with slits 24 as shown in FIG. 10, it is impossible to smoothly bend portions located at the back of the slits 24 as viewed in the direction for feeding the plate member 23*a*.

SUMMARY OF THE INVENTION

Accordingly, it is an object of the present invention to provide an apparatus for forming a long plate member or blank, which apparatus can be reduced in size.

Another object of the present invention is to provide an apparatus for forming a long plate member or blank, which can shape a plate member into a desired configuration even if the plate member is provided with slits.

The apparatus according to the invention for forming a long plate member includes feed advance means for feeding the plate member having an initial cross-section through the apparatus so that the initial cross-section is changed into a desired final sectional configuration. This apparatus further comprises an upper die, a lower die and drive means for operating the dies. The upper and lower dies define a forming part having surfaces which are in contact with each other, to press the long plate member fed into the forming part. The drive means drives at least one of the dies of the forming part up and down to perform a pressing operation.

The forming part has an initial forming region, a final forming region and intermediate forming regions. The initial forming region, which is located on an inlet for the long plate member, has a forming configuration corresponding to the initial sectional configuration of the long plate member. The final forming region, which is located on an outlet for the long plate member, has a forming configuration corresponding to the final sectional configuration of the long plate member. The intermediate forming regions, which are located between the inlet and the outlet, have forming configurations continuously changing along the direction for feeding the long plate member so that the forming configuration of the initial forming region approaches or merges into that of the final forming region.

The long plate member is fed into the forming part defined between the upper and lower dies performing a repeated press operation. In the initial forming region of the forming part, the plate member has an the initial sectional configuration. In the intermediate forming regions of the forming part, the sectional configuration of the long plate member approaches the desired final sectional configuration as the plate member is gradually moved along the feed advance direction. In the final forming region of the forming part, the long plate member is finally shaped into the desired sectional final configuration.

According to the present invention, the long plate member is press-worked into a product having a desired sectional configuration by the upper and lower dies repeatedly performing operations. Thus, it is possible to greatly reduce the overall length of the forming apparatus. Further, it is also possible to shape a long plate member which is provided with slits into, a desired configuration by pressing operations performed by the upper and lower dies.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
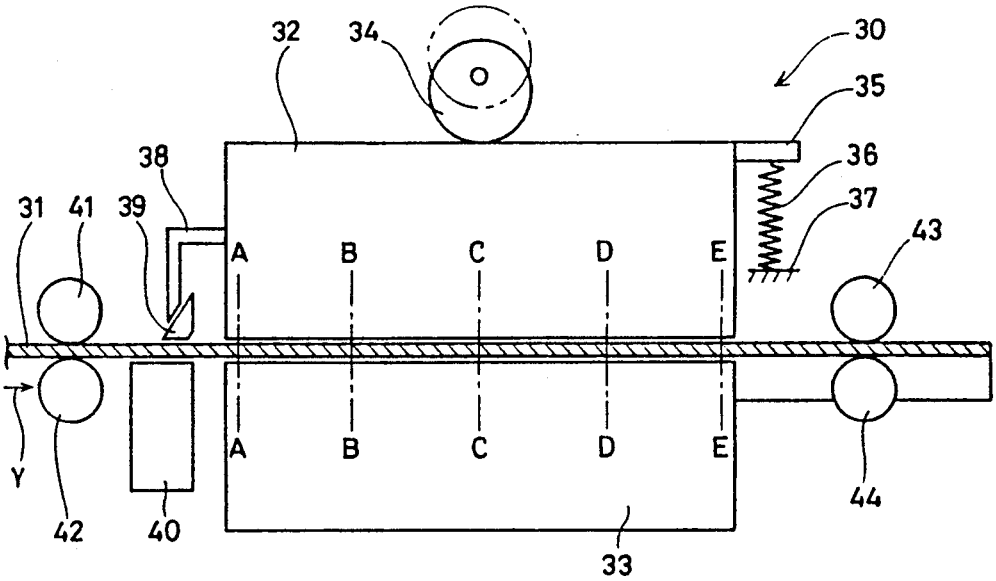
FIG. 1 is a schematic side sectional view showing an embodiment of the present invention.
Figure 9:
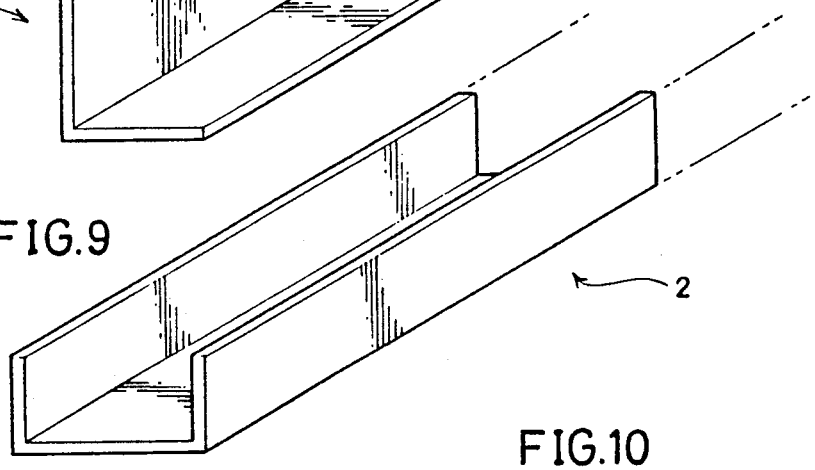
FIG. 9 is a perspective view showing a sectionally U-shaped long plate member.
Figure 10:
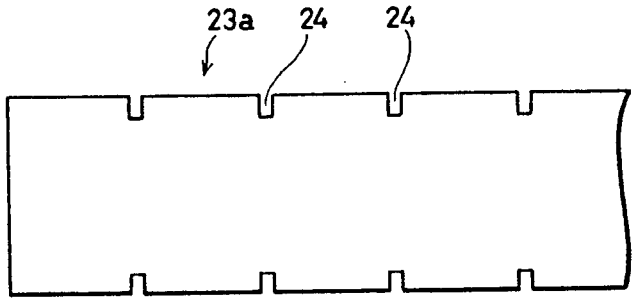
FIG. 10 is a plan view showing a long plate member provided with slits.
Figure 11:
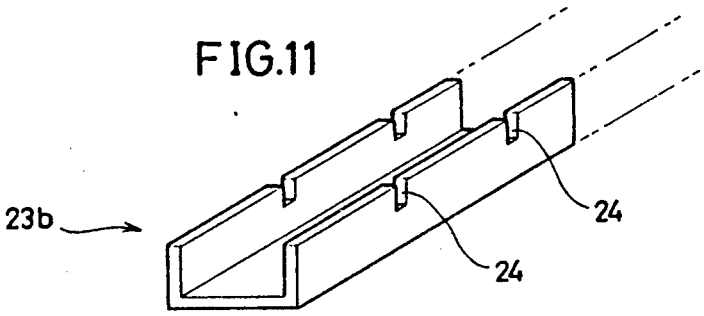
FIG. 11 is a perspective view showing a sectionally U-shaped long plate member provided with slits.
Figure 12:
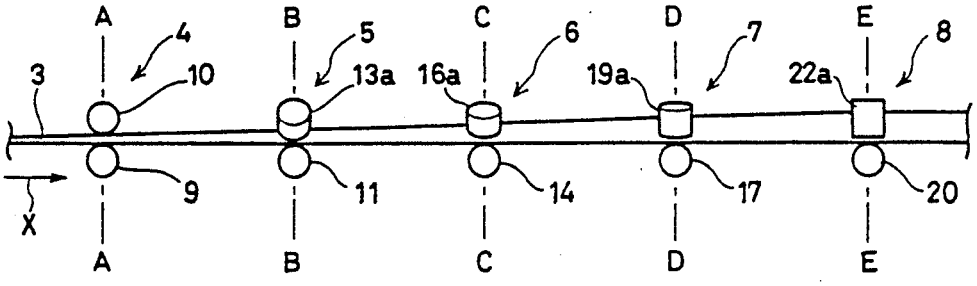
FIG.12 PRIOR ART
FIG. 12 is a schematic side elevational view showing a conventional roll forming apparatus.
Figure 13A:
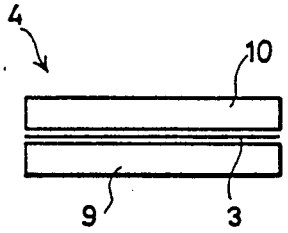
FIG.13A PRIOR ART
FIGS. 13A, 13B, 13B, 13D and 13E are schematic front sectional views taken along the lines A—A, B—B, C—C, D—D and E—E in FIG. 12.
Figure 13B:
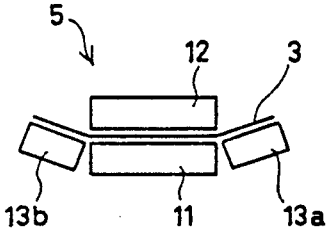
FIG.13B PRIOR ART
Figure 13C:
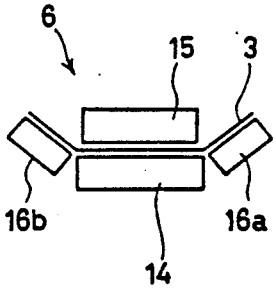
FIG.13C PRIOR ART
Figure 13D:
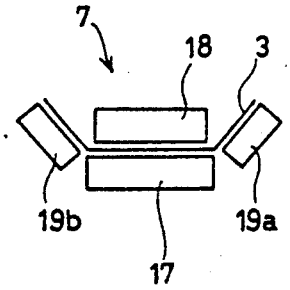
FIG.13D PRIOR ART
Figure 13E:
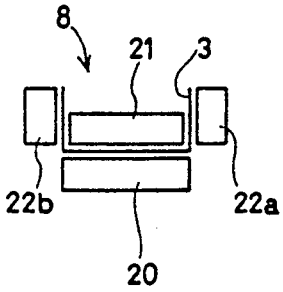
FIG.13E PRIOR ART

FIG. 1 is a schematic side sectional view showing an embodiment of the present invention. A forming apparatus 30 shown in FIG. 1 is adapted to shape a long plate member or blank 31, which is fed along a feed advance direction as indicated by an arrow Y, into a desired final sectional configuration. The blank 31 has a given initial cross-section, for example, in the form of a flat plate before forming, and finally obtains a U-shaped sectional configuration as shown in FIG. 9.

The forming apparatus 30 comprises an upper die 32, a lower die 33 and an eccentric cam 34. The upper and lower dies 32 and 33 define a forming part having forming surfaces which may contact each other. The long plate member 31 is fed into the forming part as will be described below.

A spring bearing member 35 is fixed to or mounted on the upper die 32. A compression spring 36 is arranged between a fixed frame member 37 and the spring bearing member 35. This compression spring 36 urges the upper die 32 to separate from the lower die 33.

The eccentric cam 34, which is arranged to be in contact with the upper die 32, is driven to rotate by a drive source such as a motor. When the eccentric cam 34 is rotated by the drive source, the upper die 32 vertically reciprocates to repeatedly perform pressing operations. In the state shown in FIG. 1, the upper die 32 is located in its lowermost position thereby contacting the member 31 to be shaped. When the eccentric cam 34 is rotated by 180° from the state shown in FIG. 1, the upper die 32 is urged upwardly by the compression spring 36 to separate from the lower die 33.

The long plate member 31, passing through a pair of guide rollers 41 and 42, is received in the forming part defined between the upper and lower dies 32 and 33. Then the long plate member 31 is shaped into a desired configuration by the upper and lower dies 32 and 33, and discharged from the forming part to pass through another pair of guide rollers 43 and 44.

As shown in FIG. 1, a friction member 39 is arranged between the guide roller 41 and the upper die 32 on an upper surface side of the long plate member 31. On a lower surface side of the long plate member 31, a support member 40 is arranged in a position corresponding to the friction member 39. Further, a push member 38, which can be in contact with the friction member 39, is fixed to the upper die 32. As shown in FIG. 1, the push member 38 has a downwardly facing slanted surface, while the friction member 39 has an upwardly facing slanted surface for cooperation with the downwardly facing surface of the push member 38. Since the push member 38 is fixed to the upper die 32, member 38 must move vertically up and down with the upper die 32. On the downward stroke, the two slanted surfaces engage each other, thereby stepping the plate member 31 into the shaping space between the upper and lower die. At the moment of actual shaping the plate member 31 is stationary.

Figure 4A:
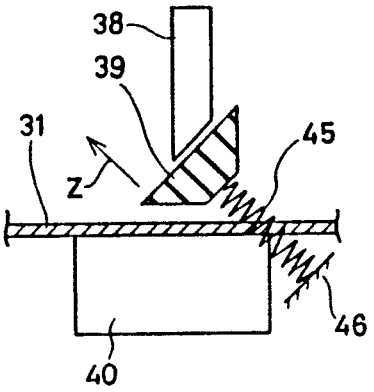
FIG. 4A is an enlarged sectional view showing the structure of a portion relating to a friction member shown in FIG. 1.

FIG. 4A is an enlarged sectional view showing a portion relating to the friction member 39. As shown in FIG. 4A, a compression spring 45 is arranged between the friction member 39 and a fixed member 46. This compression spring 45 urges the friction member 39 to move the same along an arrow Z. As mentioned upper surface of the friction member 39 is inclined so that the push member 38 comes into contact with the inclined surface. The friction member 39 is preferably made of a material having a high friction coefficient, such as rubber.

As hereinabove described, the upper die 32 vertically reciprocates in accordance with the rotation of the eccentric cam 34, to perform repeated pressing operations. The push member 38 also vertically reciprocates since the same is fixed to the upper die 32. In the state shown in FIG. 4A, the push member 38 is located in an upper position.

Figure 4B:
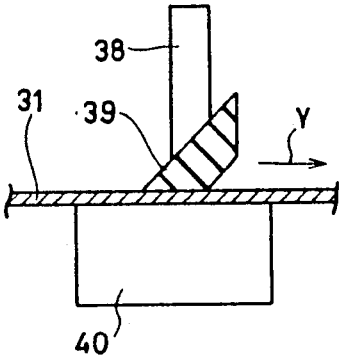
FIG. 4B shows a state of a push member moved downwardly from the state shown in FIG. 4A.
Figure 4C:
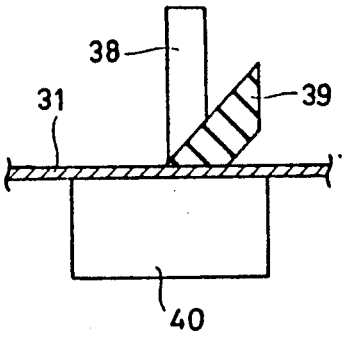
FIG. 4C shows a state of the push member moved downwardly still further from the state shown in FIG. 4B.

In a state shown in FIG. 4B, the push member 38 is in an intermediate stage of downward movement. In a state shown in FIG. 4C, the push member 38 is located in its lowermost position. As shown in FIG. 4B, the downwardly moved push member 38 pushes the friction member 39, which in turn is moved downwardly to frictionally engage with the upper surface of the long plate member 31. Since the upper surface of the friction member 39 is inclined, the friction member 39 engaging the plate member 31 is moved horizontally as indicated by the arrow Y thereby stepping the long plate member 31 forward when the push member 38 is moved further downwardly from the state shown in FIG. 4B. Then the push member 38 is upwardly moved again so that the friction member 39 is moved along the arrow Z shown in FIG. 4A by the force of the compression spring 45, to separate the friction member 39 from the long plate member 31. Such operation is repeated to stepwise feed the long plate member 31 into the forming part defined by the upper and lower dies 32 and 33. According to this embodiment, a continuous rotation of the eccentric cam causes a repeated pressing operation performed by the forming part in synchronization with the stepwise feeding of the long plate member 31.

Figure 2:
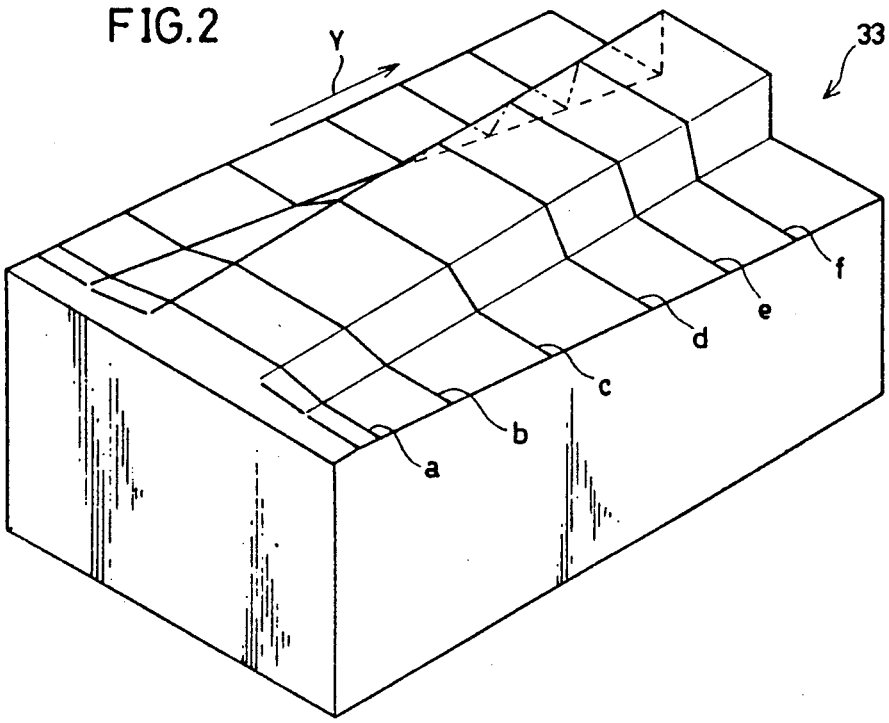
FIG. 2 is a perspective view showing a lower die 33 employed in the embodiment of the present invention.

FIG. 2 is a perspective view showing the lower die 33, and FIGS. 3A to 3E are schematic front sectional views taken along the lines A—A, B—B, C—C, D—D and E—E in FIG. 1 respectively. Referring to FIG. 2, the long plate member 31 is fed along an arrow Y. The forming part for performing the pressing operation is formed by the dies 32, 33, whereby the upper surface of the lower die 33 and the lower surface of the upper die 32 enclose a forming cavity or space. FIG. 2 clearly shows the upper surface of the lower die 33. Lines a, b, c, d, e and f appearing in FIG. 2 are drawn for convenience in order to facilitate understanding of the upper surface configuration of the lower die 33. These lines are orthogonal to the direction Y for feeding the long plate member 31. The lower surface of the upper die 32 has a configuration corresponding to the upper surface configuration of the lower die 33.

Figure 3A:
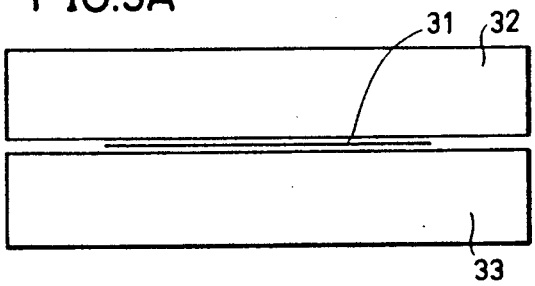
FIGS. 3A, 3B, 3C, 3D and 3E are schematic front sectional views taken along the lines A—A, B—B, C—C, D—D and E—E in FIG. 1 respectively.

As clearly understood from FIGS. 2 and 3A to 3E, the forming part defined between the upper and lower dies 32 and 33 has forming configurations continuously changing along the direction for feeding the long plate member 31. FIG. 3A shows an initial forming region of the forming part, which is located on an inlet for the long plate member 31. In this region, the forming part has a forming configuration corresponding to the initial sectional configuration of the long plate member 31. In other words, the forming part has a flat forming configuration.

Figure 3B:
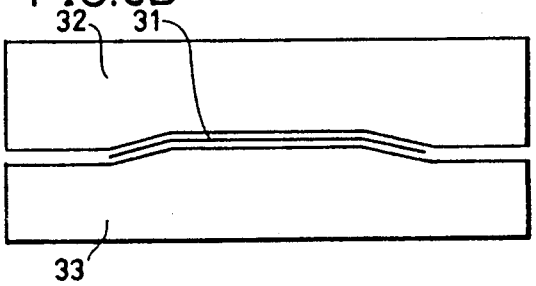
Figure 3C:
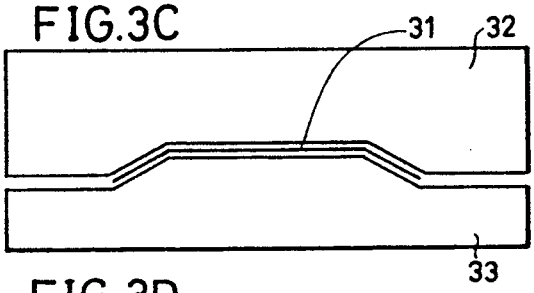
Figure 3D:
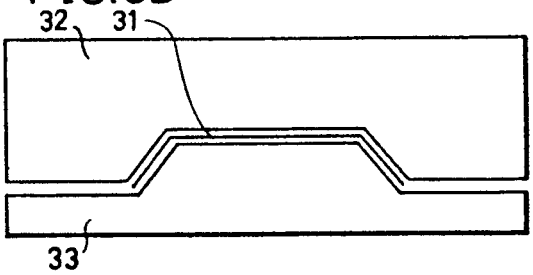
Figure 3E:
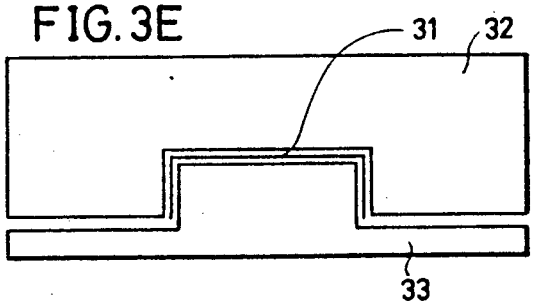

FIG. 3E shows a final forming region of the forming part, which is located on an outlet for the long plate member 31. In this region, the forming part has a forming configuration corresponding to the final sectional configuration of the long plate member 31. In other words, the forming part has a sectionally U-shaped forming configuration in the final forming region.

FIGS. 3B to 3D illustrate intermediate forming regions which are located between the inlet and the outlet for the long plate member 31. The forming configurations of the intermediate forming regions continuously change along the feed advance direction of the long plate member 31, so that the forming configuration of the initial forming region shown in FIG. 3A approaches or merges into that of the final forming region shown in FIG. 3E. More specifically, the region shown in FIG. 3B has a forming configuration capable of slightly bending both side portions of the long plate member 31. The region shown in FIG. 3C has a forming configuration capable of increasing the angle for bending the side portions of the long plate member 31, and the region shown in FIG. 3D has a forming configuration capable of further increasing said angle.

The forming part defined by the upper and lower dies 32 and 33, performs a pressing operation at a cycle of hundreds to thousands of times per minute so it is possible to speak of a "continuous" operation. The long plate member 31, which is repeatedly stepped into the forming part in synchronization with the press operation, is press-worked a number of times to finally obtain a desired U-shaped sectional configuration, and discharged from the forming part.

Figure 5:
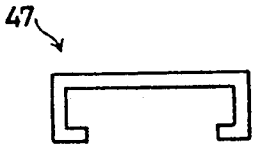
FIG. 5 is a sectional view showing a sectionally C-shaped long plate member.
Figure 6A:
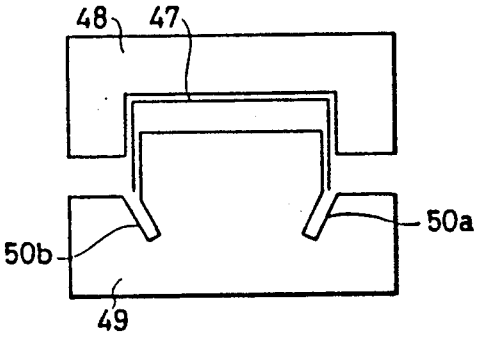
FIG. 6A is a schematic front sectional view showing upper and lower dies for forming the long plate member shown in FIG. 5.
Figure 6B:
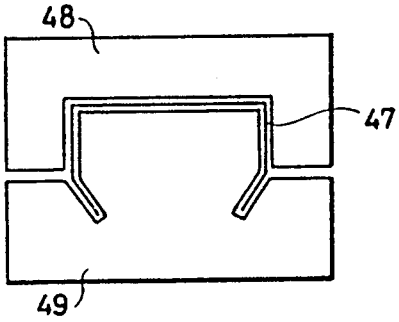
FIG. 6B shows a state of the upper die downwardly moved from the state shown in FIG. 6A.
Figure 7:
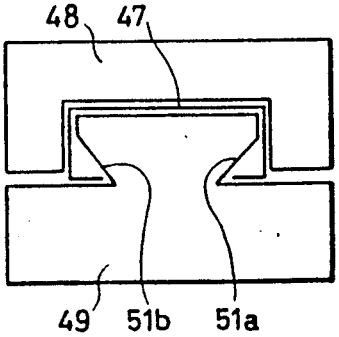
FIG. 7 is a schematic front sectional view showing a final forming region of a forming part defined by the upper and lower dies for forming the long plate member shown in FIG. 5.

According to the present invention, it is also possible to form a sectionally C-shaped long plate member 47 shown in FIG. 5 from a flat plate member. The sectionally C-shaped long plate member 47 is obtained by inwardly bending side edge portions of a sectionally U-shaped long plate member. FIGS. 6A, 6B and 7 illustrate upper and lower dies 48 and 49 for performing such press operation.

A forming part defined by the upper and lower dies 48 and 49 has an intermediate forming region shown in FIG. 6A, in continuation to the forming configurations shown in FIGS. 3A to 3E. In this intermediate forming region, the lower die 49 is provided with inwardly bent groove portions **50*a* and 50*b*. When the upper die 48 is moved downwardly from the state shown in FIG. 6A to perform a pressing operation, the side edge portions of the sectionally U-shaped long plate member 47 are inwardly bent through the groove portions 50*a* and 50*b***.

FIG. 7 shows a final forming region of the forming part defined by the upper and lower regions 48 and 49. In this final forming region, the lower die 49 is also provided with groove portions **51*a* and 51*b*. The groove portions 51*a* and 51*b* have bottom surfaces which are in parallel with the central portion of the long plate member 7. Therefore, the long plate member 47 is discharged from the forming part in such a state that both side edge portions thereof are bent in parallel with the central portion. The forming part defined by the upper and lower dies 48 and 49 shown in FIGS. 6A, 6B and 7** also has forming configurations which continuously change from the initial forming configuration shown in FIG. 3A to the final forming configuration shown in FIG. 7.

Figure 14:
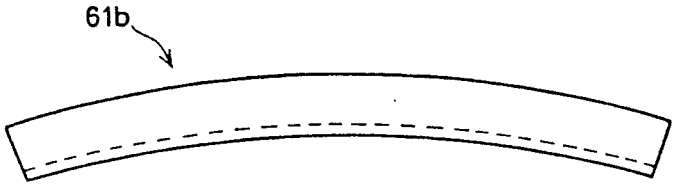
FIG. 14 is a side elevational view showing a warped long plate member.

The forming apparatus is adapted to shape a long plate member into a desired sectional configuration by performing continuously repeated pressing operations. Therefore, warpage may be caused in the long plate member discharged from the forming apparatus. FIG. 14 is a side elevational view showing a sectionally U-shaped long plate member 61*b*, which has been formed by the present forming apparatus. The long plate member 61*b* shown in FIG. 14 has a warped bottom wall portion.

Figure 15:
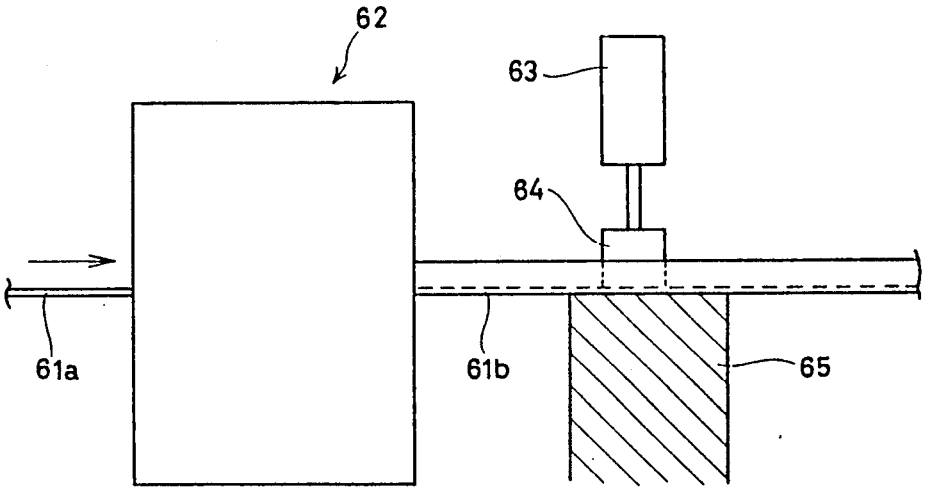
FIG. 15 schematically illustrates a warpage correcting apparatus provided as a continuation to a forming apparatus.

In order to correct such warpage of the long plate member, it is preferable to provide a warpage correcting apparatus as a continuation of the forming apparatus. FIG. 15 shows a preferred example of such a warpage correcting apparatus. A flat plate member 61*a* is shaped by a forming apparatus 62 into a sectionally U-shaped long plate member 61*b*. The warpage correcting apparatus comprises a support 65, a hydraulic cylinder 63, and a presser die 64 which is mounted on the forward end of a piston rod of the hydraulic cylinder 63. The presser die 64 applies a pressing force to the bottom wall portion of the sectionally U-shaped long plate member 61*b*, which is discharged from the forming apparatus 62, to correct its warpage.

Figure 16:
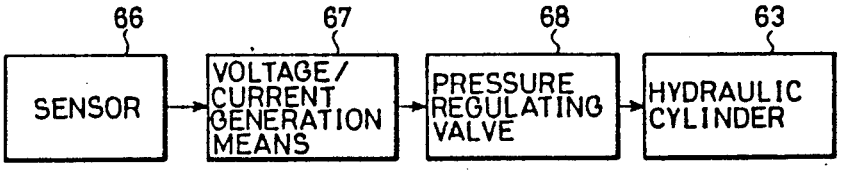
FIG. 16 is a block diagram schematically showing the structure of the warpage correcting apparatus.

The hydraulic pressure of the hydraulic cylinder 63 may be regulated in response to the amount of warpage of the long plate member 61*b*. FIG. 16 is a block diagram schematically showing the schematic structure of such a warpage correcting apparatus. A sensor 66 detects the amount of warpage of the long plate member 61*b* which is discharged from the forming apparatus, and converts the same to an electric signal. A voltage/-current generation means 67 receives the electric signal from the sensor 66, and generates a voltage or current signal in response to the amount of warpage. A pressure regulating valve 68 receives the electric signal from the voltage/current generation means 67 to open/close its valve, thereby regulating the hydraulic pressure of the hydraulic cylinder 63 in response to the amount of warpage.

Figure 8:
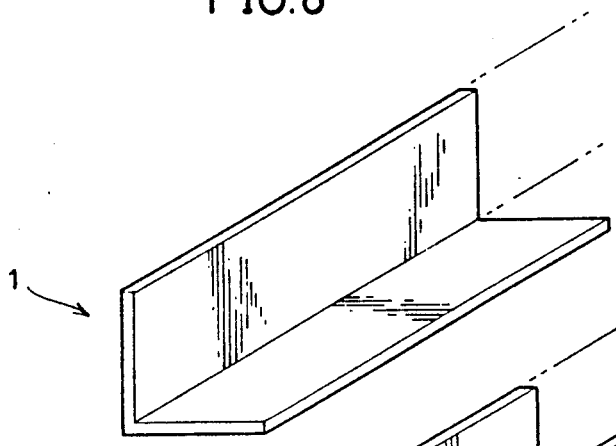
FIG. 8 is a perspective view showing a sectionally L-shaped long plate member.

The aforementioned embodiment is adapted to work a long plate member 31 which is in the form of a flat plate in the initial state before forming. However, the long plate member to be worked may not necessarily be a flat plate. For example, it is also possible to finally obtain the sectionally U-shaped long plate member shown in FIG. 9 from the sectionally L-shaped long plate member shown in FIG. 8.

Although the eccentric cam 34 is employed in the above embodiment as the drive means for performing the repeated pressing operations of the forming part, similar operation may be implemented by various other mechanisms, instead of such an eccentric cam.

In the aforementioned embodiment, the long plate member 31 is fed by the push member 38 and the friction member 39 as described. However, such members may be replaced by a dedicated feeding mechanism for stepwise feeding the long plate member 31.

In the aforementioned embodiment, both of the upper and lower dies have sectional configurations continuously changing along the direction for feeding the long plate member. However, the present forming apparatus may be modified in such a manner that either the upper or the lower die has a sectional configuration which continuously changes along the direction for feeding the long plate member, while the other die has a sectional configuration which is uniform along the feed advance direction of the long plate member 31.

Figure 17:
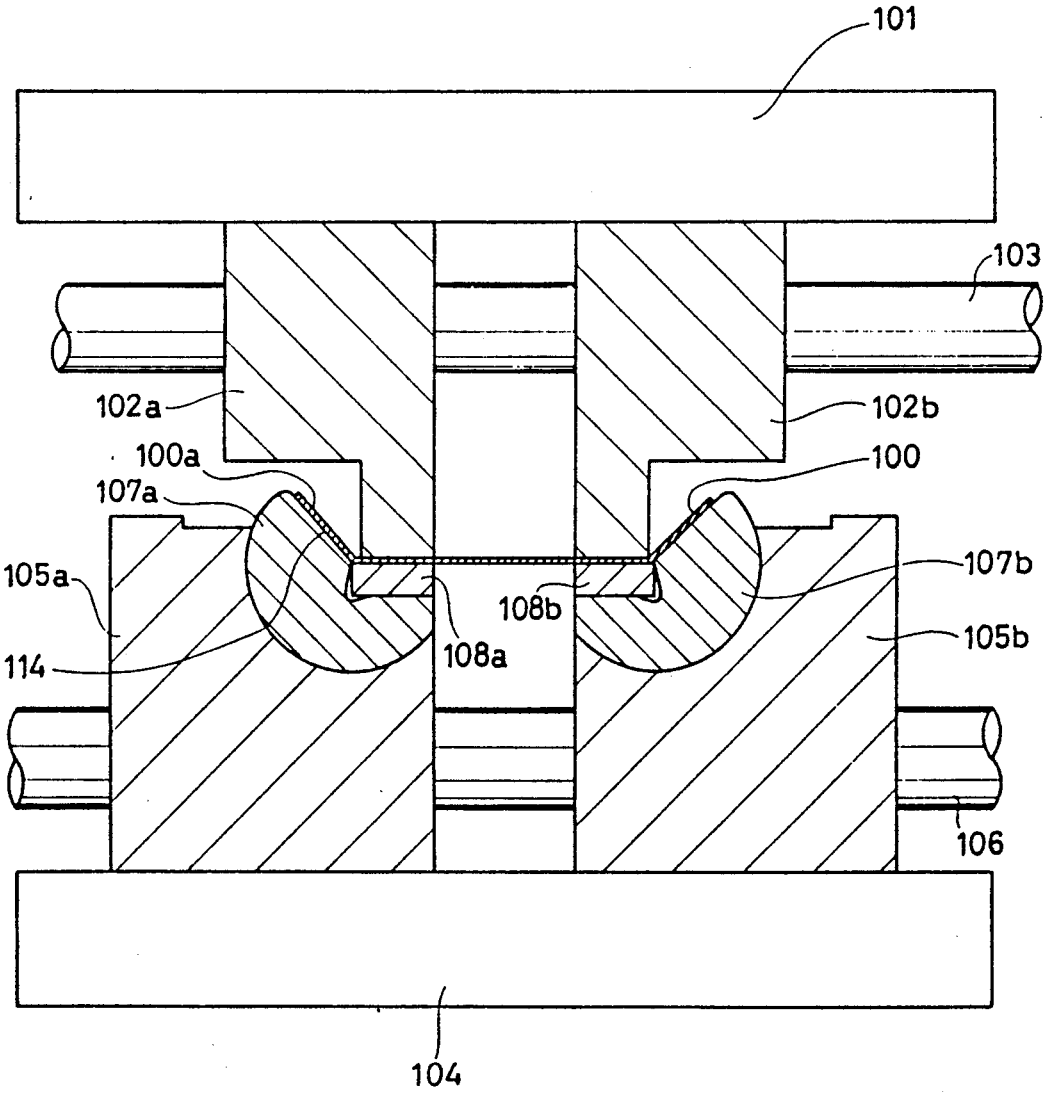
FIG. 17 is a schematic sectional view showing another embodiment of the present invention.

FIG. 17 illustrates another embodiment of the present invention in a section which is orthogonal to the direction for feeding a long plate member 100. The long plate member 100 has a flat cross-section in an initial stage before forming, similarly to the long plate member 31 shown in FIG. 3A, and finally obtains a U-shaped sectional configuration, as shown in FIG. 9. FIG. 17 shows sectional configurations of upper and lower dies which are located in an intermediate forming region.

Figure 18:
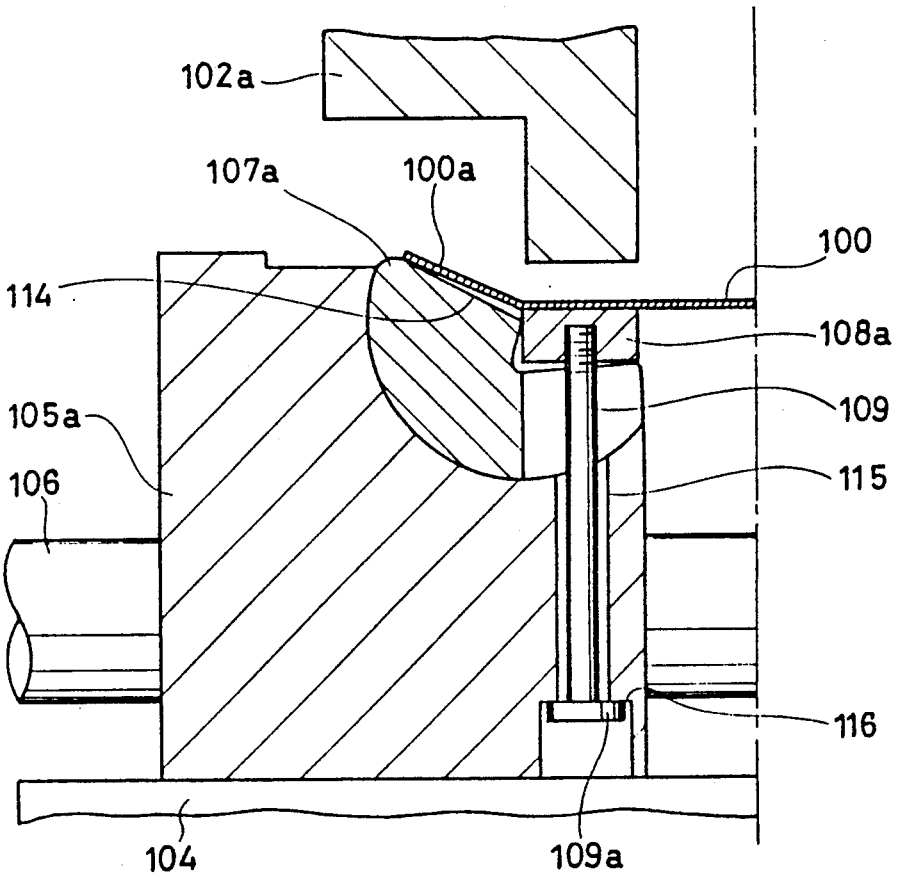
FIG. 18 is a schematic sectional view showing upper and lower dies which are located in an intermediate forming region.
Figure 19:
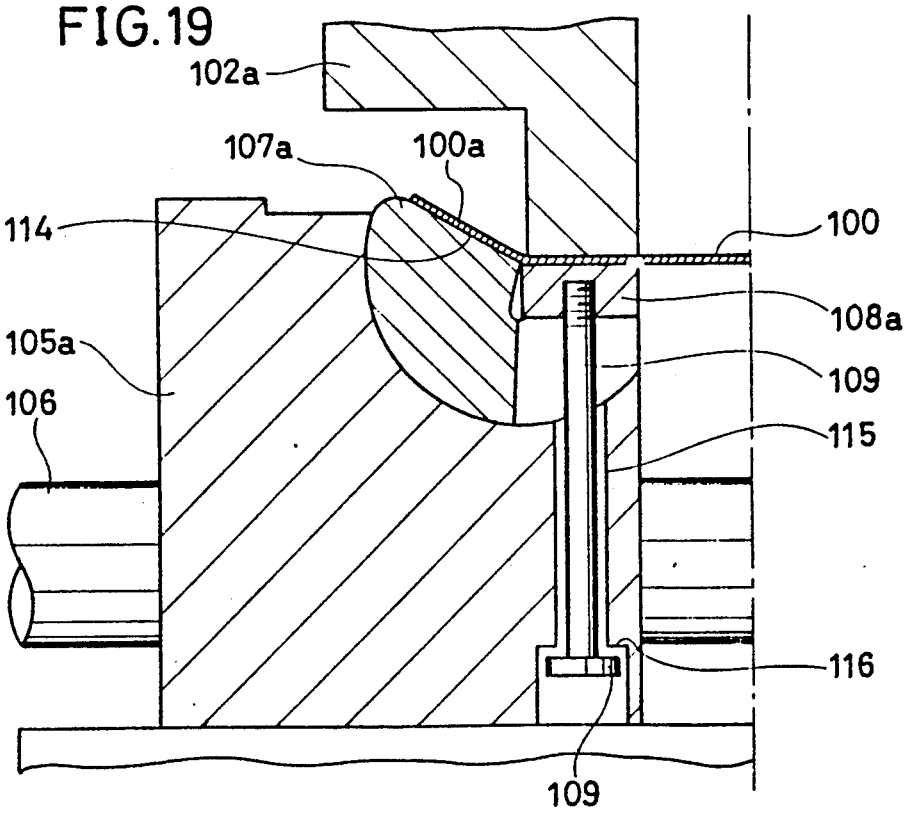
FIG. 19 is a sectional view showing a state of the upper die moved downwardly from the state shown in FIG. 18.
Figure 20:
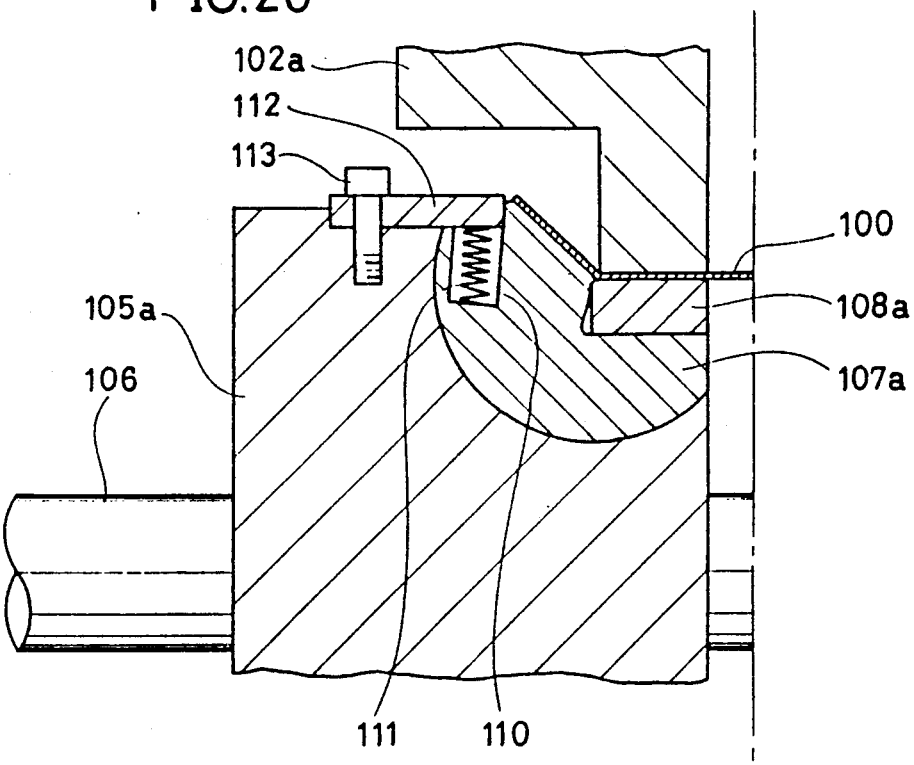
FIG. 20 is a schematic sectional view showing the upper and lower dies located in another intermediate forming region, closer to a final forming region.
Figure 21:
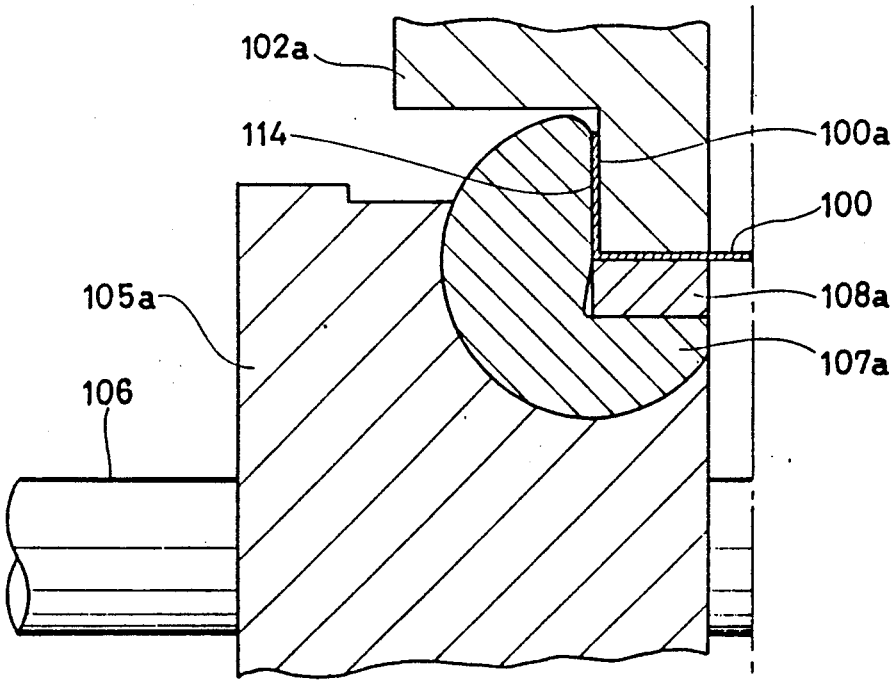
FIG. 21 is a schematic sectional view showing the upper and lower dies located in the final forming region.

FIGS. 18 and 19 also show the sectional configurations of the upper and lower dies located in the intermediate forming region. FIG. 20 shows sectional configurations of the upper and lower dies which are located in another intermediate forming region closer to a final forming region as compared with the positions shown in FIGS. 18 and 19. FIG. 21 shows sectional configurations of the upper and lower dies which are located in the final forming region, while FIG. 22 shows sectional configurations of the upper and lower dies which are located in an initial forming region.

Figure 22:
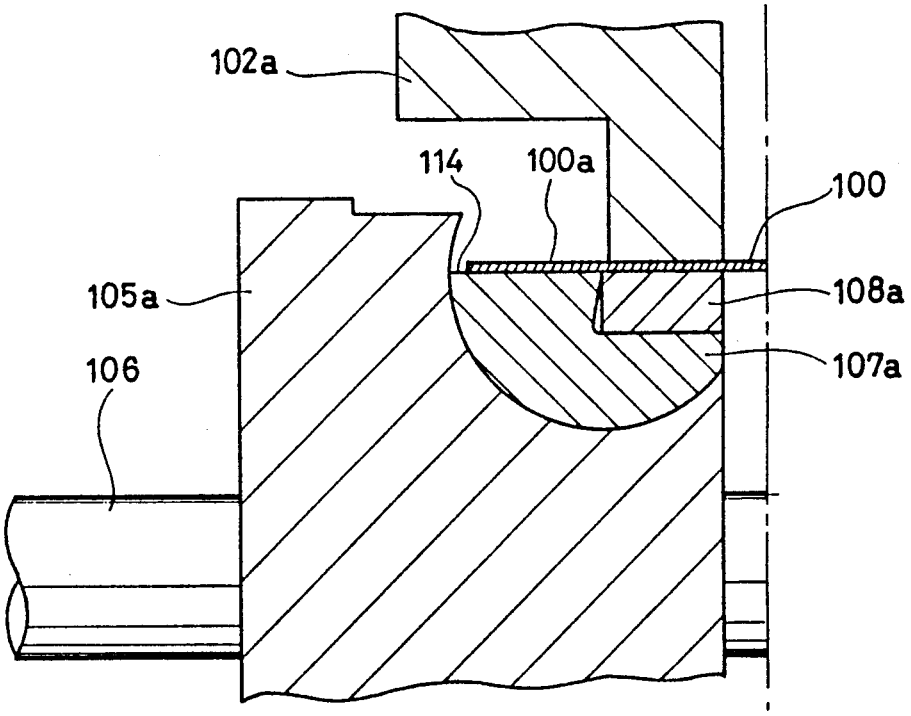
FIG. 22 is a schematic sectional view showing the upper and lower dies which are located in an initial forming region.

The forming apparatus shown in FIGS. 17 and 22 comprises an upper base member 101, first and second upper dies 102*a* and 102*b*, a rotary shaft 103, a lower base member 104, first and second support members 105*a* and 105*b*, another rotary shaft 106, first and second lower dies 107*a* and 107*b*, and presser members 108*a* and 108*b*.

The first and second upper dies 102*a* and 102*b* are horizontally slidable along the upper base member 101 respectively. The rotary shaft 103 passes through the first and second upper dies 102*a* and 102*b*. The rotary shaft 103 has a screw thread and the first and second upper dies 102*a* and 102*b* are also provided with respective screw threads that engage the screw thread of the shaft 103. The first upper die 102*a* is provided with a left screw thread, and the second upper die 102*b* is provided with a right screw thread. When the rotary shaft 103 is driven to rotate, the first and second upper dies 102*a* and 102*b* are moved in opposite directions. The upper base member 101, the first and second upper dies 102*a* and 102*b* and the rotary shaft 103 integrally reciprocate along the vertical direction.

The lower base member 104 is fixed to the body of the firming apparatus. The first and second support members 105*a* and 105*b* are horizontally slidable along the lower base member 104 respectively. The rotary shaft 106 passes through the first and second support members 105*a* and 105*b*. The rotary shaft 106 and the first and second support members 105*a* and 105*b* are provided with engaging screw threads. The first support member 105*a* is provided with a left screw thread, and the second support member 105*b* is provided with a right screw thread. When the rotary shaft 106 is driven to rotate, the first and second support members 105*a* and 105*b* are moved in opposite directions.

The first and second upper dies 102*a* and 102*b* are movable in opposite directions while the first and second support members 105*a* and 105*b* are also movable in opposite directions, so that the forming apparatus is readily applicable to various types of long plate members. More specifically, the rotary shaft 103 or 106 is driven to rotate in response to a variation in thickness of the long plate member, to optimize the distance between the pair of upper dies 102*a* and 102*b* or the pair of lower dies 107*a* and 107*b*. Further, both of the rotary shafts 103 and 106 are driven to rotate in response to variation in bent portions of the long plate member, to optimize the distances between the pair of upper dies 102*a* and 102*b* and the pair of lower dies 107*a* and 107*b*.

The first lower die 107*a* is rotatably supported on the first support member 105*a*. The second lower die 107*b* is rotatably supported on the second support member 105*b*. The first and second lower dies 107*a* and 107*b* are so located that centers of rotation thereof substantially conform with inflection points of the long plate member 100. The presser members 108*a* and 108*b* are located between the long plate member 100 and the first and second lower dies 107*a* and 107*b*. The structure relating to the first lower die 107*a* and the presser member 108*a*, which are located on the left-hand side in FIG. 17, is substantially identical to the structure relating to the second lower die 107*b* and the presser member 108*b*, which are located on the right-hand side. Thus, the following description is made only with reference the structure relating to the first lower die 107*a* and the presser member 108*a*.

Referring to FIGS. 18 to 22, the first lower die 107*a*-has a working surface 114, which supports a bent portion 100*a* of the long plate member 100. FIG. 22 shows a sectional configuration located in the initial forming region, and FIG. 21 shows a sectional configuration located in the final forming region. These figures clearly show, that the working surface 114 of the first lower die 107*a* extends substantially along a horizontal plane in the initial forming region, while the same extends along a vertical plane which is substantially perpendicular to the horizontal plane in the final forming region. In the intermediate forming regions, the inclination of the working surface 114 of the first lower die 107*a*changes continuously from the position along the horizontal plane as shown in FIG. 22 to the position along the vertical plane as show in FIG. 21.

The sectional configuration of the first upper die 102*a* remains uniform from the initial forming region to the final forming region. The sectional configuration of the presser member 108*a* also remains uniform from the initial forming region to the final forming region. The presser member 108*a* supports the lower central portion of the long plate member 100.

Referring to FIG. 20, the first lower die 107*a* is provided with a hole 110 in an appropriate position along the direction for feeding the long plate member 100. A spring 111 is received in this hole 110. A plate 112 is fixed to or mounted on the first support member 105*a* by a screw 113. This plate 112 presses the upper end portion of the spring 111. The first lower die 107*a* is urged by the force of the spring 111 to rotate counterclockwise in FIG. 20.

Referring again to FIG. 18, the first support member 105*a* is provided with a vertical through hole 115 in an appropriate position along the direction for feeding the long plate member 100. A screw 109 passes through this through hole 115, and its forward end portion is fixed to the presser 108*a*. In the state shown in FIG. 18, the first upper die 102*a* is upwardly positioned apart from the long plate member 100. In the state shown in FIG. 19, on the other hand, the first upper die 102*a* presses the long plate member 100, and a clearance is defined between a head portion 109*a* of the screw 109 and a step portion 116 of the first support member 105*a*. When the first upper die 102*a* is moved upwardly as shown in FIG. 18, the first lower die 107*a* is anticlockwisely rotated by the spring 111 (FIG. 20). Following such rotation of the first lower die 107*a*, the presser member 108*a* is moved upwardly by the first lower die 107*a*. Then the head portion 109*a* of the screw 109 comes into contact with the step portion 116 of the first support member 105*a*, to inhibit an upward movement of the presser member 108*a* and a counterclockwise rotation of the first lower die 107*a*.

In order to work a flat long plate member into a sectionally U-shaped configuration, the first and second upper dies 102*a* and 102*b* reciprocate vertically in response to as driving force applied by appropriate drive means. In response to such vertical reciprocation of the first and second upper dies 102*a* and 102*b*, the first and second lower dies 107*a* and 107*b* are reciprocatingly rotated substantially about the inflection points of the lower plate member 100. Due to such vertical reciprocation of the first and second upper dies 102*a* and 102*b* and reciprocating rotation of the first and second lower dies 107*a* and 107*b*, the flat long plate member 100 introduced into the inlet of the forming apparatus is worked into a sectionally U-shaped configuration, and discharged from the outlet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for forming a long plate member by changing a long plate blank having an initial cross-section, into a final sectional configuration, said apparatus comprising: an upper die and a lower die defining a forming part having contact surfaces of said upper and lower dies for pressing said long plate blank, means for feeding said long plate blank into said forming part, drive means for driving at least one of said upper and lower dies to perform a pressing operation in said forming part, said forming part including: an initial forming region located next to an inlet for said long plate blank, said initial forming region having a forming configuration corresponding to said initial cross-section, a final forming region located next to an outlet for said long plate blank, said final forming region having a forming configuration corresponding to said final sectional configuration, and wherein said upper die and said lower die have sectional configurations that are continuously changing along a feed advance direction of said long plate blank for defining said initial forming region, said final forming region, and intermediate forming regions located between said inlet and said outlet, said upper and lower die sectional configurations changing along said feed advance direction so that said forming configuration of said initial forming region approaches said forming configuration of said final forming region through said intermediate forming regions.

2. An apparatus for forming a long plate member by changing a long plate blank having an initial cross-section, into a final sectional configuration, said apparatus comprising: an upper die and a lower die defining a forming part having contact surfaces of said upper and lower dies for pressing said long plate blank, feed advance means for feeding said long plate blank into said forming part along a feed advance direction, drive means for driving at least one of said upper and lower dies to perform a pressing operation in said forming part, said drive means comprising a spring (36) for upwardly urging said upper die (32) and rotatable, eccentric cam drive means (34) driven in contact with an upper portion of said upper die (32) for urging said upper die downwardly against said spring, said forming part including: an initial forming region located next to an inlet for said long plate blank, said initial forming region having a forming configuration corresponding to said initial cross-section, a final forming region located next to an outlet for said long plate blank, said final forming region having a forming configuration corresponding to said final sectional configuration, and intermediate forming regions located between said inlet and said outlet, one of said upper and lower die sectional configurations changing along said feed advance direction so that said forming configuration of said initial forming region merges into said forming configurations of said final forming region through said intermediate forming regions.

3. The apparatus of claim 2, further comprising synchronizing means (39, 45) for synchronizing said pressing operation with an operation of said feed advance means.

4. The apparatus of claim 3, wherein said synchronizing means includes a friction member (39) located between said upper die (32) and said long plate blank (31), said friction member being pressed downwardly by a respective movement of said upper die to frictionally engage with said long plate blank during a pressing operation.

5. An apparatus for forming a long plate member by changing a long plate blank having an initial cross-section, into a final sectional configuration, said apparatus comprising: an upper die and a lower die defining a forming part having contact surfaces of said upper and lower dies for pressing said long plate blank, means for feeding said long plate blank into said forming part, drive means for driving at least one of said upper and lower dies to perform a pressing operation in said forming part, said forming part including: an initial forming region located next to an inlet for said long plate blank, said initial forming region having a forming configuration corresponding to said initial cross-section, a final forming region located next to an outlet for said long plate blank, said final forming region having a forming configuration corresponding to said final sectional configuration, and intermediate forming regions located between said inlet and said outlet, one of said upper and lower die sectional configurations changing along a feed advance direction so that said forming configuration of said initial forming region merges into said forming configuration of said final forming region through said intermediate forming regions, and wherein said lower die comprises: a first lower die portion (107*a*) and a second lower die portion (107*b*) which are spaced apart from each other; and spacing control means (106) for controlling a spacing between said first lower die portion (107*a*) and said second lower die portion (107*b*).

6. The apparatus of claim 5, wherein said upper die comprises: a first upper die portion (102*a*) and a second upper die portion (102*b*) which are spaced apart from each other; and further spacing control means (103) for controlling a spacing between said first upper die portion (102*a*) and said second upper die portion (102*b*).

7. The apparatus of claim 5, wherein said final sectional configuration of said long plate member (100) includes a bent portion where flat plate portions meet at an angle with each other, and means for rotatably supporting said lower die (107*a*, 107*b*) close to said bent portion.

* * * * *